US005313763A

United States Patent [19]

Oram

[11] Patent Number: 5,313,763

[45] Date of Patent: May 24, 1994

[54] DOME-SHAPED STRUCTURE AND METHOD OF CONSTRUCTING SAME

[76] Inventor: John G. Oram, 790 Bateswood Dr., #19, Houston, Tex. 77079

[21] Appl. No.: 902,911

[22] Filed: Jun. 24, 1992

[51] Int. Cl.[5] ..... E04B 1/32

[52] U.S. Cl. ..... 52/80.2; 52/82; 52/292; 52/745.07

[58] Field of Search ..... 52/80.2, 81.1, 292, 52/82, 745.07; 135/102, 104, 98, 908

[56] References Cited

U.S. PATENT DOCUMENTS

| | | | |
|---|---|---|---|
| 35,630 | 6/1862 | Rumbold . | |
| 2,167,048 | 7/1939 | Legarda . | |
| 2,771,087 | 11/1956 | Simonson | 135/98 X |
| 3,028,706 | 4/1962 | Falconer . | |
| 3,085,366 | 4/1963 | Jamison | 52/82 X |
| 3,113,403 | 12/1963 | MacMillan, Jr. et al. | 52/125.2 X |
| 3,130,488 | 4/1964 | Lindstrom | 52/82 X |
| 3,683,427 | 8/1972 | Burkholz | 52/82 X |
| 3,874,397 | 4/1975 | Oberhaus | 135/98 |
| 3,894,367 | 7/1975 | Yacoboni . | |
| 3,924,367 | 12/1975 | Stewart | 52/82 X |
| 3,929,146 | 12/1975 | Maiken | 135/98 |
| 3,999,337 | 12/1976 | Tomassetti, Jr. | 52/82 |
| 4,023,582 | 5/1977 | Buzzella | 52/82 X |
| 4,033,366 | 7/1977 | Forget | 135/98 |
| 4,144,680 | 3/1979 | Kelly . | |
| 4,192,107 | 3/1980 | Wickstrom | 52/82 |
| 4,364,208 | 12/1982 | Wilson | 52/82 |
| 4,541,210 | 9/1985 | Cook | 52/745.01 X |
| 4,663,898 | 5/1987 | Yacaboni . | |
| 4,703,594 | 11/1987 | Reber | 52/745.07 X |
| 4,720,947 | 1/1988 | Yacaboni | 52/82 X |
| 4,776,145 | 10/1988 | Dykmans | 52/169.7 X |
| 4,784,172 | 11/1988 | Yacaboni | 52/82 X |
| 4,848,046 | 7/1989 | Wallhead | 52/82 X |
| 5,002,083 | 3/1991 | Kim | 135/98 |
| 5,094,044 | 3/1992 | Dykmans | 52/2.15 X |
| 5,238,014 | 8/1993 | Cai | 135/102 |

FOREIGN PATENT DOCUMENTS

| | | | |
|---|---|---|---|
| 2259927 | 3/1993 | United Kingdom | 135/98 |

OTHER PUBLICATIONS

Popular Mechanics, Aug. 1956, p. 75, Domed College Arena Built Without Pillars.

*Primary Examiner*—Carl D. Friedman
*Assistant Examiner*—Beth A. Aubrey
*Attorney, Agent, or Firm*—Pravel, Hewitt, Kimball & Krieger

[57] ABSTRACT

A dome-shaped structure and method of constructing same is disclosed having a base foundation and a plurality of inner and outer stringers. Each inner and outer stringer has a first end which is circumferentially spaced and attached to the base foundation. The structure includes a support assembly for supporting the second end of the plurality of inner and outer stringers at a substantially central location above the base foundation. The circumferentially spaced inner stringers are located within the periphery formed by the circumferentially spaced outer stringers at the base foundation and the second ends of the plurality of inner stringers are below the second ends of the plurality of outer stringers. An outer shell is attached to the plurality of outer stringers and an inner shell is attached to the plurality of inner stringers. A substantially continuous enclosed space is formed between the inner and outer shells.

22 Claims, 8 Drawing Sheets

DOME-SHAPED STRUCTURE AND METHOD OF CONSTRUCTING SAME

BACKGROUND OF THE INVENTION

1. Field of the Invention

The present invention relates to dome-shaped s and to a method of constructing the same, and more specifically to dome-shaped housing structures.

2. Description of the Prior Art

There has long been a need for an inexpensive, sturdy housing structure which can be quickly erected with a minimum of cost. Obviously, it is necessary that the housing structure have adequate structural strength and require a minimum of maintenance and upkeep. Additionally, the housing structure should be aesthetically and architecturally pleasing to gain acceptability.

The structural advantages of a dome-shaped structure are well known by engineers and architects. Various dome-shaped structures are disclosed in U.S. Pat. Nos. 4,663,898, 4,144,680, and 3,894,367. U.S. Pat. Nos. 4,663,898 and 3,894,367 disclose a dome-shaped structure having a plurality of preshaped load-bearing members affixed to a foundation and meeting at a common vertex above the foundation. U.S. Pat. No. 4,144,680 discloses a dome-shaped structure formed of bent, preferably tubular, vertically extending members to which are clamped laterally extending members which are disposed on opposite sides of the bent vertical members. Inner and outer shells are attached to the laterally extending members forming an air pocket between the shells.

It is desirable to have a dome-shaped structure of lightweight construction, low construction cost, minimal construction time, high insulating characteristics, pleasing appearance, and extreme versatility.

SUMMARY OF THE PRESENT INVENTION

The present invention is a dome-shaped structure of lightweight construction, low construction cost, minimal construction time, high insulating characteristics, pleasing appearance, and extreme versatility.

In the preferred embodiment, the dome-shaped structure has a base foundation having an inner series and an outer series of circumferentially spaced sockets recessed in the foundation. The radius of the inner series of circumferentially spaced sockets is approximately twelve inches less than the outer series. A center support includes two rings, an upper and a lower, vertically separated by approximately twelve inches. Each ring includes a quantity of holes corresponding to the number of sockets in each series of circumferentially spaced sockets. The holes in the upper ring receive stringers which extend from the upper ring down to the outer series of sockets. The holes in the lower ring receive a second set of stringers which extend from the lower ring to the inner series of sockets. The inner series of sockets is offset midway between the outer series of sockets. Similarly, the holes of the lower ring are offset midway between the holes of the upper ring. The holes in the rings face substantially horizontally, whereas the sockets are substantially vertically positioned in the foundation. Thus, the stringers will bow from a substantially vertical position at the foundation to a substantially horizontal position at the center support rings.

Preferably, the construction of the dome-shaped structure is accomplished by inserting the sockets into the wet concrete after pouring a concrete slab foundation. After the concrete has cured, the center support is positioned on the center of the slab foundation and the stringers are inserted into the holes in the upper and lower rings. The center support is then vertically lifted above the slab foundation and the stringers are permitted to deflect downwardly. The lower ends of the stringers are then inserted into the sockets, completing the erection of the dome framing.

The inner series of stringers and the outer series of stringers will be the support members for inner and outer shells, respectively, and for the center support rings. The space between the inner and outer shells provides excellent insulating characteristics while also providing a continuous space to install ventilation ductwork, piping, plumbing, electrical cables, etc. around the perimeter of the structure. If desirable, insulation can be installed in the space between the inner and outer shells by various means.

Installed above the center support is a skylight dome which will provide much natural lighting to all areas of the structure. Doors and windows/portholes may be installed in the perimeter shell walls of the structure. Moveable partitions or walls are installed in the structure and secured with partition stays spanning between the top of the partition and the inner series of stringers. Thus, room sizes and floorplans may be modified with relative ease. Certain limitations exist with respect to relocating rooms such as kitchens and bathrooms having permanently installed fixtures such as toilets, sinks, range hookups, etc. Nonetheless, the present invention provides great versatility, minimal construction and maintenance costs, and reduced construction time.

BRIEF DESCRIPTION OF THE DRAWINGS

A better understanding of the invention can be had when the following detailed description of the preferred embodiment is considered in conjunction with the following drawings, in which.

DETAILED DESCRIPTION OF THE INVENTION

Figure 1:
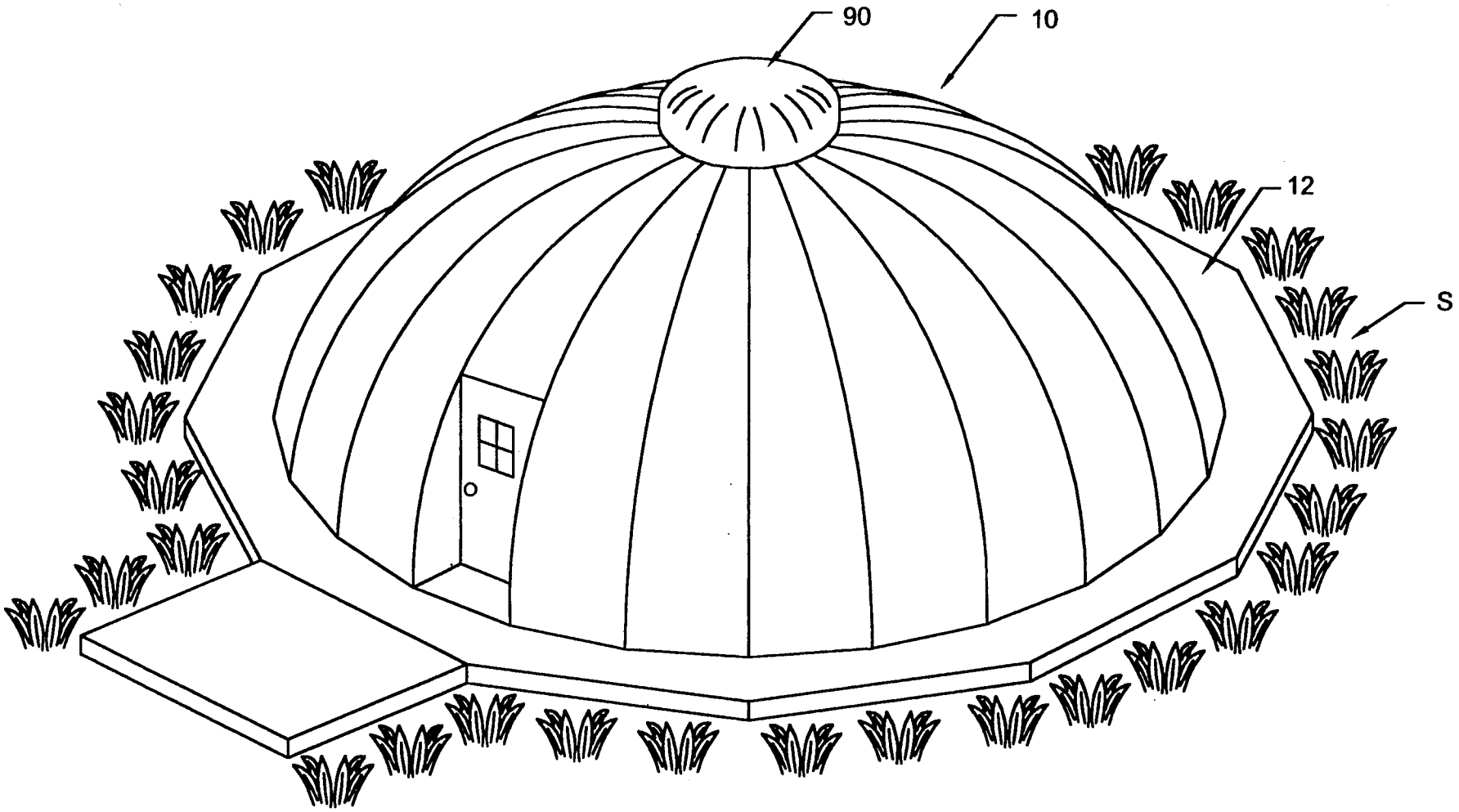
FIG. 1 is a perspective view of the dome-shaped structure according to the preferred embodiment of the present invention.
Figure 2:
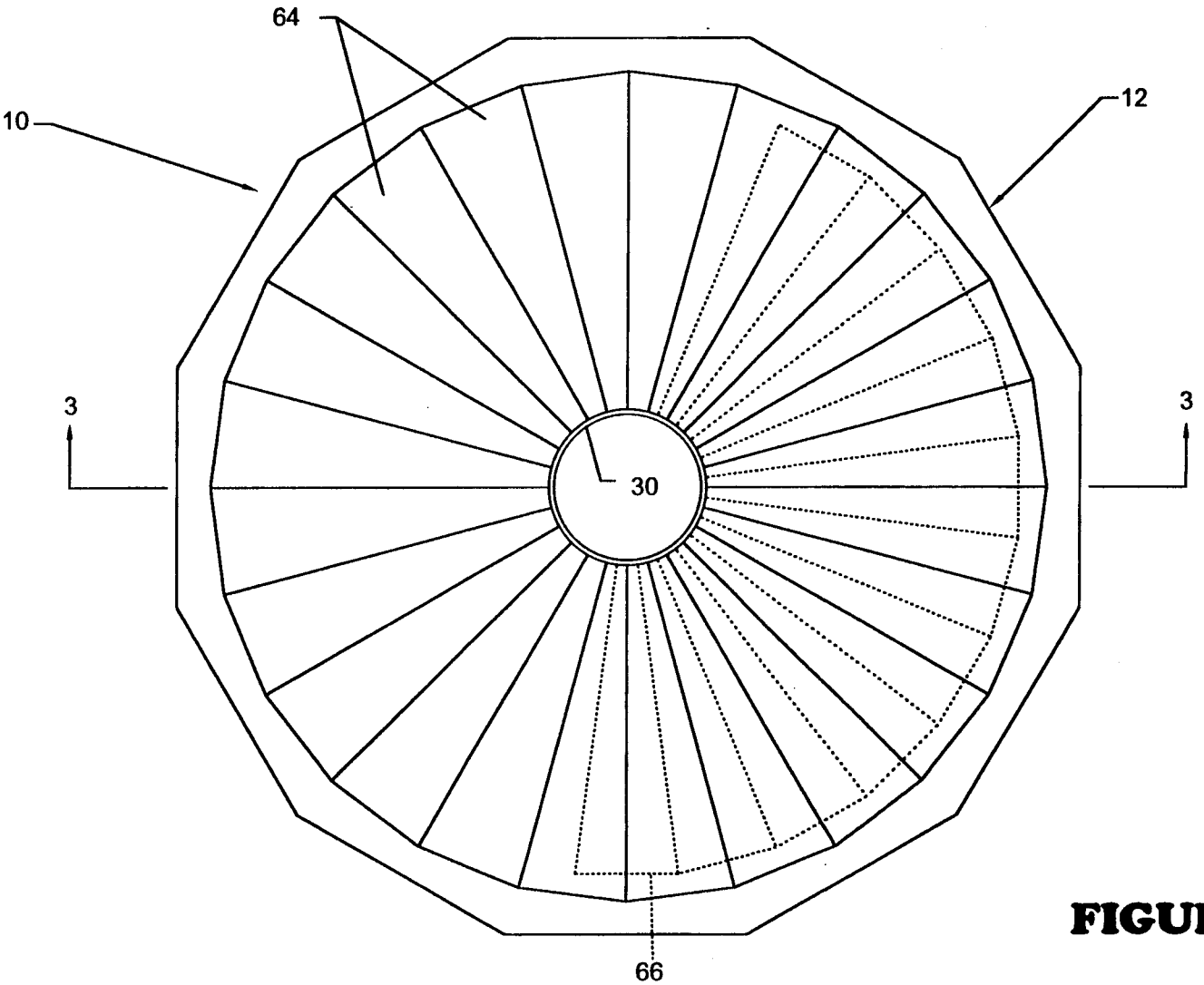
FIG. 2 is a plan view of the dome-shaped structure of FIG. 1.

The dome-shaped structure according to the preferred embodiment, designated generally as 10, is shown in FIG. 1. The structure 10 includes a base foundation 12, typically of concrete, for supporting and securing the structure 10. The base foundation 12 is supported by the soil designated generally as S. As shown in FIGS. 1 and 2, the dome-shaped structure 10 in the preferred embodiment is generally hemispherical in shape. It is to be understood that the structure 10 according to the present invention is not limited to hemispherical shapes but also includes domes having a generally elliptical shape as well as free-form shapes.

Figure 4:
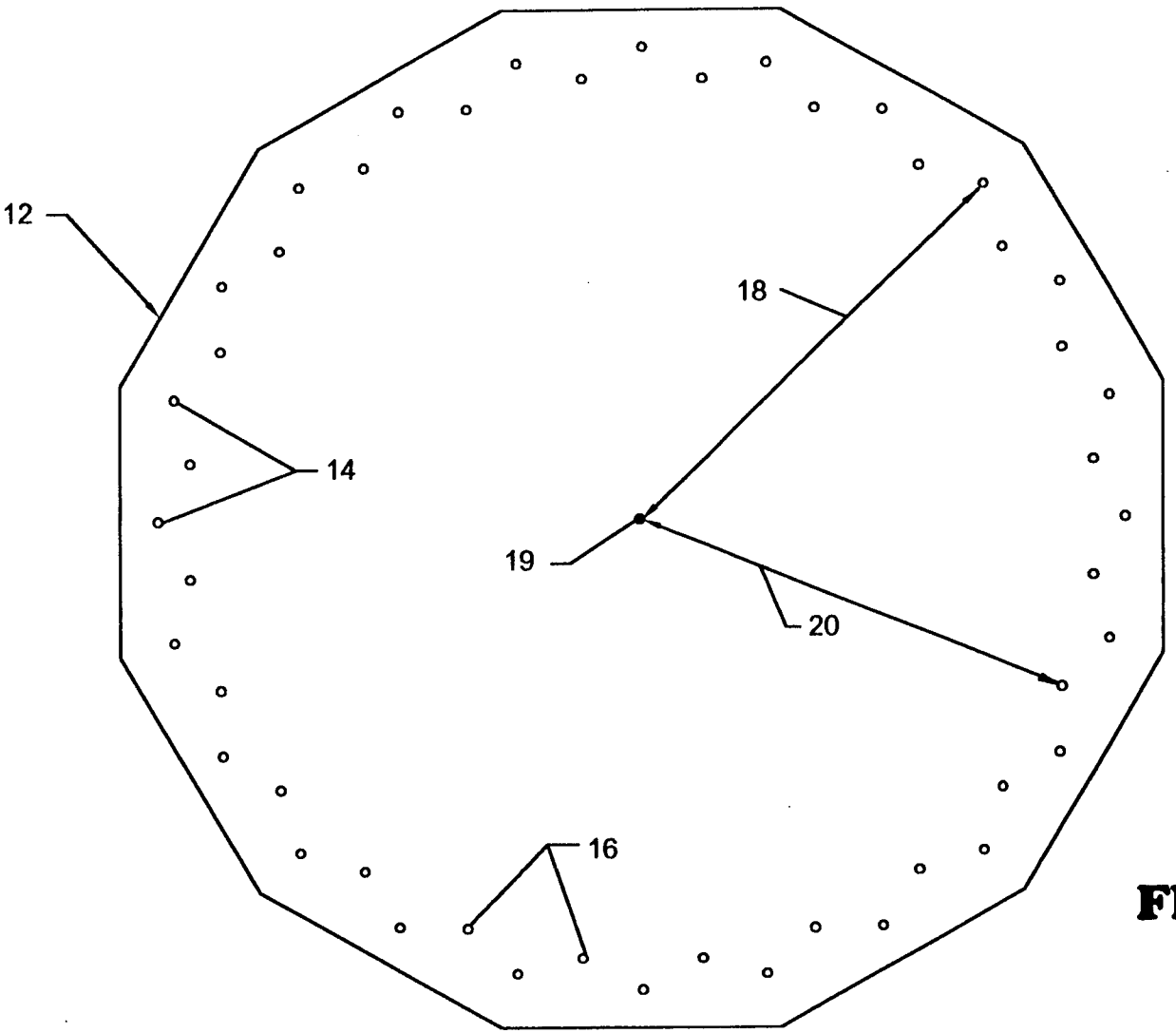
FIG. 4 is a plan view of the base foundation with the inner and outer plurality of sockets.

Referring to FIGS. 1 and 2, the base foundation 12 is slightly greater in diameter than the dome portion of the structure 10 for reasons which will be explained in detail below. As shown in FIGS. 2 and 4, the base foundation 12 in the preferred embodiment is a dodecagon, a regular polygon having twelve sides. Obviously, the base foundation 12 may be a circle or any other convenient shape surrounding the outer periphery of the dome portion of the structure 10.

Referring to FIG. 4, the base foundation 12 includes a series of circumferentially spaced outer sockets 14 and a series of circumferentially spaced inner sockets 16 installed at the base foundation 12. In the preferred embodiment, the inner and outer sockets 16 and 14 respectively are embedded in the concrete foundation 12. The inner and outer sockets 16, 14 may be short tubular segments of pipe recessed into the base foundation 12. In the preferred embodiment, the sockets are made from fiberglass reinforced polyester (FRP). As shown in FIG. 4, the outer sockets 14 are uniformly spaced at an outer radius 18 from the centerpoint 19 of the base foundation 12. The inner sockets 16 are uniformly spaced at an inner radius 20 from the centerpoint 19 of the base foundation 12. As shown in FIG. 4, the inner radius 20 is less than the outer radius 18. In the preferred embodiment, the inner radius 20 is approximately twelve inches less than the outer radius 18 for reasons which will be explained below. Additionally, in the preferred embodiment, each inner socket 16 is located on the inner radius 20 midway between the adjacent pair of outer sockets 14.

Figure 3:
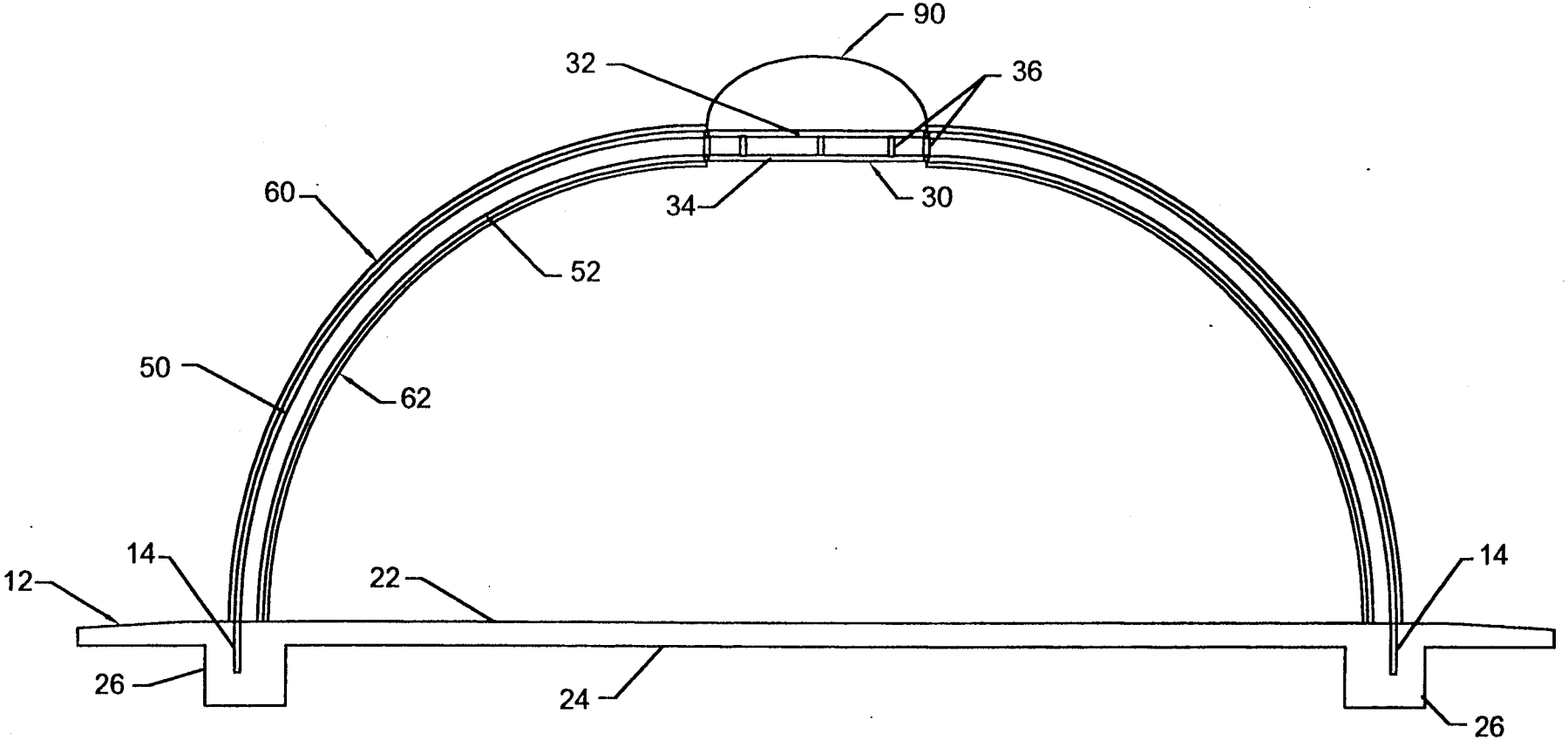
FIG. 3 is a section view taken along lines 3—3 of FIG. 2.

Referring to FIG. 3, the base foundation 12 has a substantially flat upper surface 22 and a lower surface 24 having a circumferential footing 26 of generally rectangular cross-section. The footing 26 provides additional strength to the base foundation 12 and also provides increased depth for receiving the embedded inner and outer sockets 16, 14.

Figure 6:
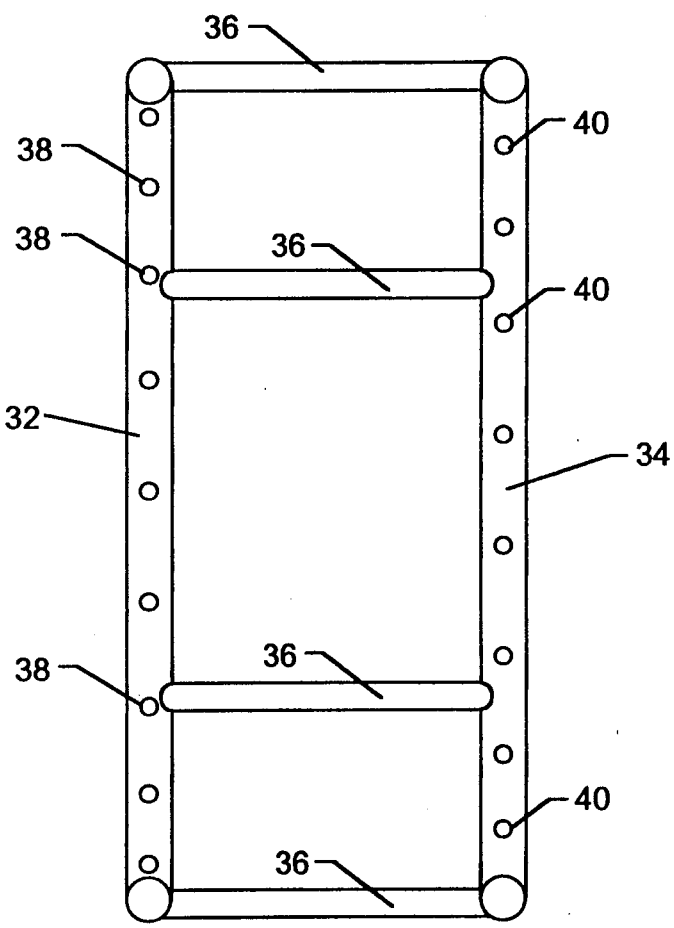
FIG. 6 is an elevation of the center support.
Figure 5:
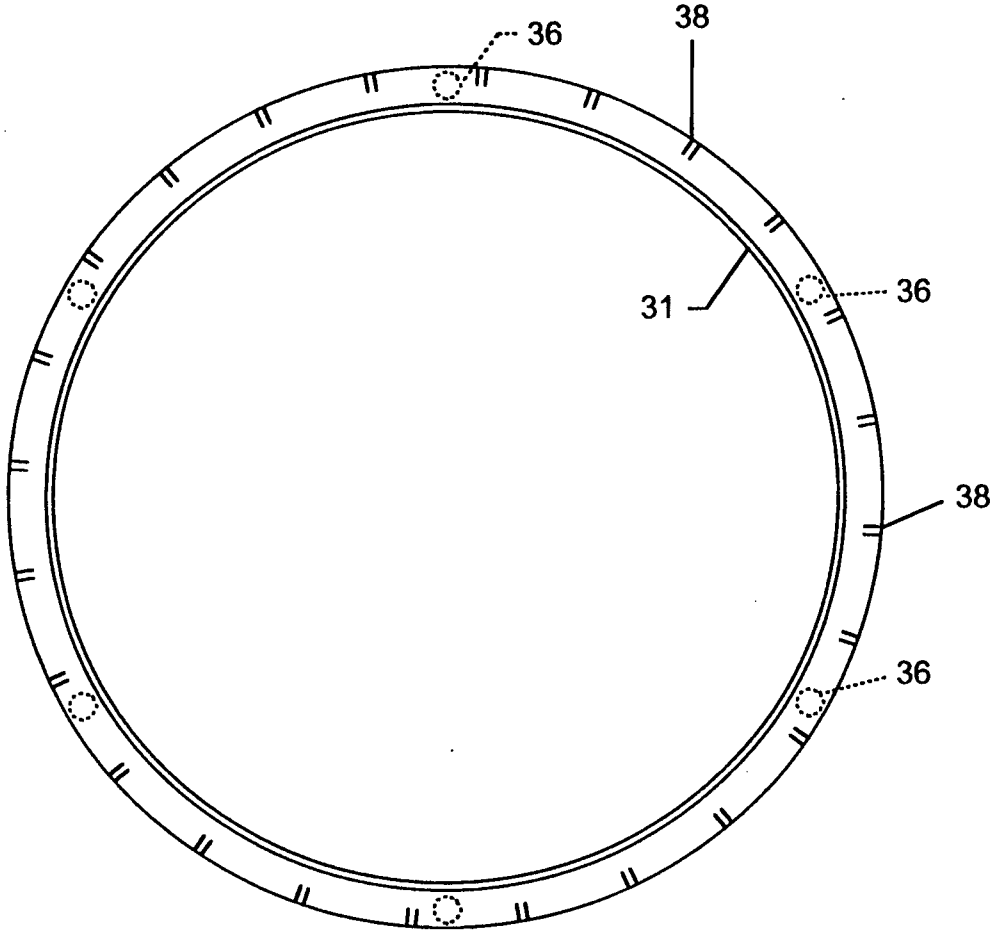
FIG. 5 is a plan view of the center support.

Referring to FIGS. 3, 5, and 6, a center support, designated generally as 30, includes an upper ring 32 and a lower ring 34. Preferably, the center support 30 is made from FRP and the upper and lower rings 32 and 34 are heavy-wall pipe. In the preferred embodiment, the center-to-center distance between the upper ring 32 and the lower ring 34 is approximately the same distance as between the inner radius 20 and the outer radius 18 of the sockets, or twelve inches. The separation between the upper and lower rings, 32 and 34 respectively, is maintained by a plurality of braces 36 as shown in FIGS. 3 and 6.

Referring to FIGS. 5 and 6, the upper ring 32 includes a quantity of holes 38 corresponding to the number of sockets 14 in the series of outer sockets 14. Similarly, the lower ring 34 includes a quantity of holes 40 corresponding to the number of sockets 14 in the series of inner sockets 16. As shown in FIG. 6, the holes 40 in the lower ring 34 are located substantially midway between the holes 38 in the upper ring 32. In the preferred embodiment, the holes 38 and 40 are in the outer diameter and do not extend through the rings 32 and 34.

Referring to FIG. 5, the center support 30 includes a seal 31 which fits against the inner peripheral surface of the upper and lower rings 32 and 34. The seal 31 is a flat strip of FRP material having a width of approximately twelve inches in the preferred embodiment and a length substantially equal to the inner circumference of the rings 32 and 34. The seal 31 is bent to fit against the inner peripheral surface of the rings 32 and 34 and seals off the void space formed between the inner and outer shells as will be described below.

Referring to FIG. 3, each hole 38 in the upper ring 32 receives an outer stringer 50 which extends from the upper ring 32 down to a corresponding outer socket 14. Similarly, each hole 40 in the lower ring 34 receives an inner stringer 52 which extends from the lower ring 34 down to a corresponding inner socket 16. The inner stringers 52 are shorter in length than the outer stringers 50 such that the inner stringers 52 are maintained substantially a uniform radial distance from the outer stringers 50 from the center support 30 to the base foundation 12 as shown in FIG. 3. The inner stringers 52 are radially spaced midway between the outer stringers 50 as a result of the placement of the sockets 14, 16 and the holes 38, 40 in the center support 30. The stringers 50 and 52 may be solid or tubular members depending on the size of the structure 10 and the required flexibility and strength of the stringers 50, 52. The stringers 50, 52 are preferably made of FRP.

The holes 38 and 40 in the rings 32 and 34 face substantially horizontally, whereas the sockets 14 and 16 are substantially vertically positioned in the foundation 12. Thus, the stringers 50 and 52 will bow from a substantially vertical position at the foundation 12 to a substantially horizontal position at the center support 30.

There are other means of attaching the stringers 50, 52 to the center support 30. Some other means of attaching include having short stubs extending from the rings 32, 34 on which tubular stringers 50, 52 can be mounted, or by including short sockets extending from the rings into which the stringers can be inserted. This is not meant to be exhaustive of the various means of attaching the stringers to the rings. Additionally, it should be noted that the center support 30 could be formed from solid rod having a diameter equal to the diameter of the rings 32, 34 with any of the various means for attaching the stringers. Alternatively, the center support 30 could be formed from a sheet rolled to the large diameter of the center support 30 to thus form a large diameter, short tubular section. The tubular section would then have the plurality of holes 38 and 40 or any of the various other means for attaching the stringers to the center support as described above.

Referring to FIGS. 1, 2, and 3, the series of inner stringers 52 and the series of outer stringers 50 provide support for inner and outer shells, 62 and 60 respectively. In the preferred embodiment, the inner and outer shells 62 and 60 are comprised of a plurality of inner and outer shell segments, 66 and 64 respectively. Each outer shell segment 64 is precut to fit between the adjacent pair of outer stringers 50 from the base foundation 12 to the center support 30. Each inner shell segment 66 is similarly precut to fit between the adjacent pair of inner stringers 52. In the preferred embodiment, the outer shell segments 64 are fabricated from FRP. The inner shell segments 66 are preferably fabricated from FRP or polyvinyl chloride (PVC). Since the shell segments 64 and 66 are positioned between adjacent pairs of stringers 50 and 52, the shell segments 64 and 66 are bent only in one plane. This results in a faceted dome as shown in FIG. 2.

Figure 7:
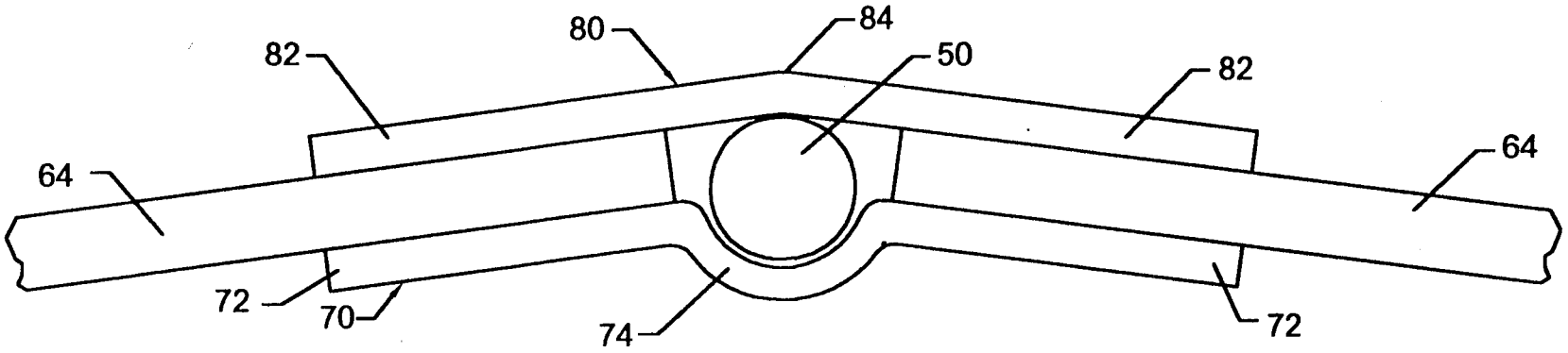
FIG. 7 is a view showing shell segments attached to a stringer, with shell clip and joint cover.

Referring to FIG. 7, a pair of outer shell segments 64 are attached to an outer stringer 50 by a shell clip 70 and a joint cover 80. The shell clip 70 has a pair of extending flanges 72 which are joined by a substantially semi-circular midportion 74. The semi-circular midportion 74 has a radius approximating or slightly greater than the radius of the stringer 50. The extending flanges 72 form an angle with respect to one another equal to the angle formed by a line connecting three adjacent outer stringers 50. It is to be understood that the inner shell segments 66 are attached to the inner stringers 52 with shell clips 70 and joint covers 80 in the same manner as described above and shown in FIG. 7.

As shown in the Figures and by way of example, the illustrated embodiment shows twenty-four stringers in each series of stringers 50, 52. The stringers in each series 50, 52 are spaced every fifteen degrees. Applying geometry principles, the angle formed by a line connecting three adjacent inner or outer stringers 52, 50 is 165° (180°-15°). Thus, the extending flanges 72 of the shell clip 70 are at an angle of 165° with respect to one another. It should be noted that this angle will vary with changes in the number of stringers, configuration, etc.

The joint cover 80 has a pair of extending flanges 82 which are joined at a midsection 84. The extending flanges 82 are at an angle of 165° with respect to one another as shown in the preferred embodiment. Alternatively, instead of using the joint cover 80, FRP tape could be used to cover the joint.

Preferably, the sockets 14 and 16, the stringers 50 and 52, the center support 30, the shell segments 64 and 66, the shell clips 70, and the joint covers 80 are all made out of FRP. This provides ample strength characteristics, excellent durability, and is lightweight. All FRP used in the structure will contain ultraviolet (UV) protection to prevent deterioration from sunlight, and a flame retardant to prevent spread of fire.

Referring to FIG. 1, a skylight dome 90 is installed above the center support 30. The skylight dome 90 provides natural lighting to all interior areas of the structure 10.

Figure 9:
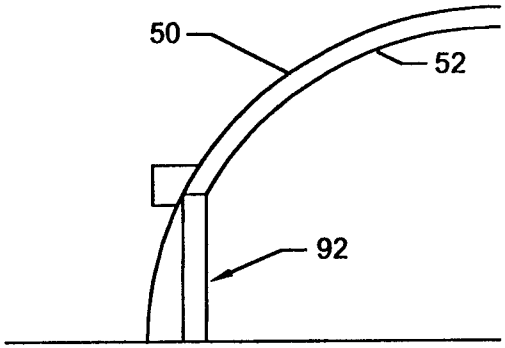
FIG. 9 is a side view of the door frame shown in FIG. 8.
Figure 10:
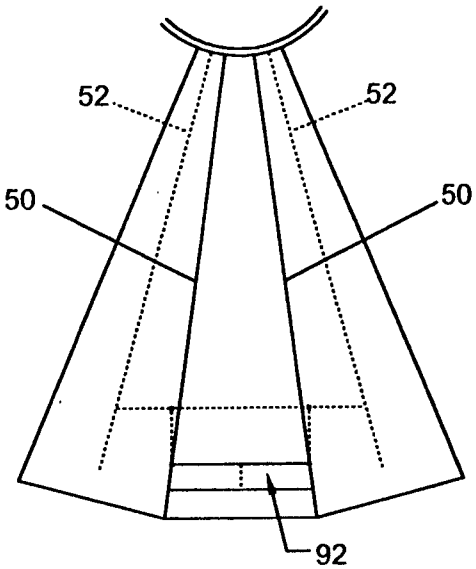
FIG. 10 is a top view of the door frame shown in FIG. 8.
Figure 8:
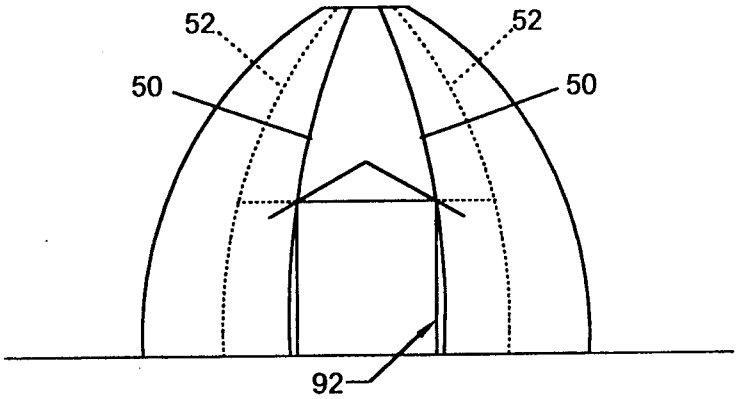
FIG. 8 is an elevation view of a door frame.

Doors and windows or portholes are installed in the perimeter shell walls of the structure 10. Referring to FIGS. 8-10, a typical door framing, designated generally as 92, is shown. The door framing 92 is connected or tied into the inner and outer stringers 52 and 50 respectively. Depending on the size of the structure 10 and the spacing of the stringers, it may be necessary to eliminate one or more stringers to allow adequate spacing for the door framing 92. FIGS. 8 and 10 show an inner stringer eliminated in the center of the door framing 92 and the door framing 92 is tied into the adjacent inner stringers 52. It is to be understood that the same general framing technique as shown for the door can also be used for windows or portholes. Preferably, both the door framing 92, the door, and the window/porthole framing are made from FRP.

Figure 12:
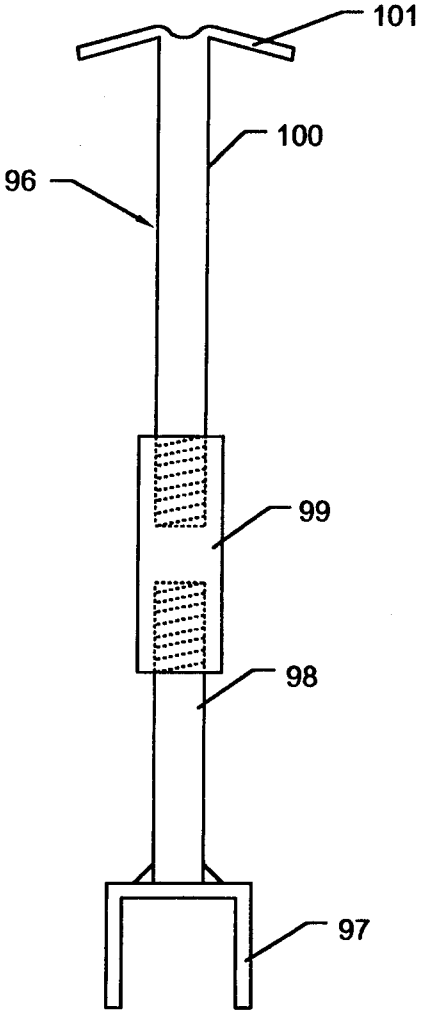
FIG. 12 is an elevation view of a partition stay.
Figure 11:
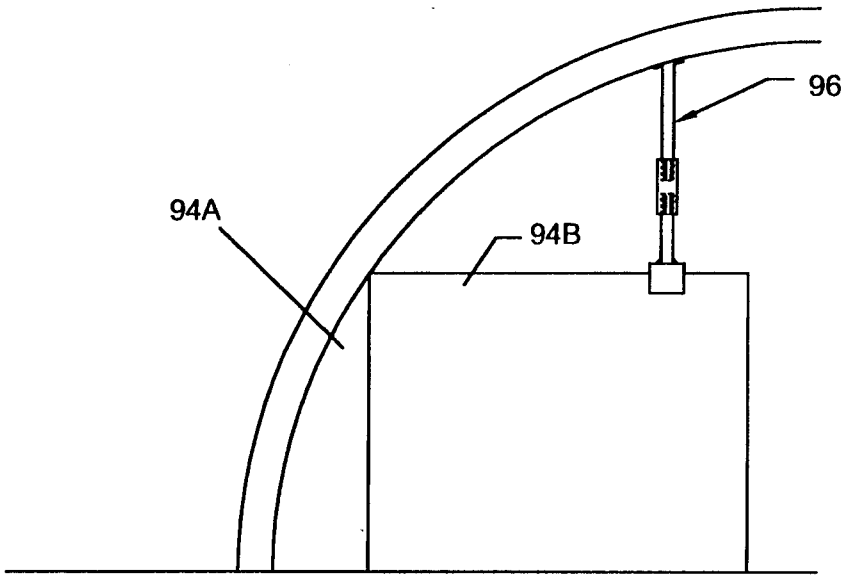
FIG. 11 is an elevation view of a moveable interior partition assembly.

Referring to FIGS. 11 and 12, moveable interior partitions or walls 94A and 94B are installed in the structure 10 and may be secured with various means, including partition stays 96 spanning between the top of the partition 94B and the shell clip 70 on the inner stringer 52. Partition 94A is a formed partition which conforms to the curvature of the inner shell 62 or inner stringers 52. Partition 94B is a rectangular partition which can be joined to the formed partition 94A by a typical commercial attachment device commonly used in joining office partitions, for example. Preferably, the bottom of both of the partitions 94A and 94B have a securing means for securing the partitions to the floor surface. Suitable attaching means may include short spikes or carpet nails which extend from the bottom of the partitions and engage a carpeted floor surface.

The partition stay 96 has a lower U-shaped channel 97 which is connected to a lower threaded rod 98. The lower threaded rod 98 is threadably received in a threaded socket 99. The partition stay 96 further includes an upper threaded rod 100 which is threadably received in the threaded socket 99. Attached to the upper end of the upper threaded rod 100 is a clip 101 which abuts a shell clip 70 on an inner stringer 52. The threaded socket 99 has right-hand threads at one end and left-hand threads at the second end so that by rotating the threaded socket 99 in one direction the threaded rods 98 and 100 extend outward. The U-shaped channel 97 fits over the top of the partition 94B and the clip 101 is positioned against the shell clip 70 on the inner stringer 52. The threaded socket 99 is rotated to extend the threaded rods 98 and 100 until the partition 94B is firmly secured by the partition stay 92.

It is apparent from the above description that room sizes and floorplans may be modified with relative ease in the structure 10. Certain limitations exist with respect to relocating rooms such as kitchens and bathrooms having permanently installed fixtures such as toilets, sinks, range hookups, etc. Nonetheless, the present invention provides great versatility, minimal construction and maintenance costs, and reduced construction time.

The space between the inner and outer shells, 62 and 60 respectively, provides excellent insulating characteristics while also providing a continuous space to install heating, ventilating and air conditioning ductwork, piping, electrical cables, etc. around the perimeter of the structure 10. If desirable, insulation can be installed in the space between the inner and outer shells by various means.

METHOD OF CONSTRUCTION

Referring to FIG. 4, the construction of the dome-shaped structure 10 is accomplished by pouring a concrete slab foundation 12. Preferably, the outer periphery of the slab foundation has a slight downward taper to aid in the drainage of water from the outer shell 60 of the structure 10 as shown in FIG. 3. The inner and outer series of circumferentially spaced sockets, 16 and 14 respectively, are inserted into the wet concrete in a substantially vertical position.

After the concrete has cured, the center support 30 is temporarily supported above the center of the slab foundation 12. The inner stringers 52 are inserted into the inner sockets 16. Depending on the size of the structure 10 and the spacing of the stringers it may be necessary to omit an inner stringer 52 at each door location as shown in FIGS. 8 and 10.

It should be noted that the inner and outer stringers 52 and 50 are preferably elongated, straight members. The stringers 50 and 52 are not preshaped to their ultimate curved configuration for reasons which will be explained below.

The inner stringers 52 are bowed and inserted into the corresponding holes 40 of the lower ring 34. Each of the bowed stringers assumes its natural curvature when supported in the identical manner at the base foundation 12 and at the center support 30. The bowed stringers 52 provide excellent structural load bearing characteristics whether the loads are vertical or horizontal. The bowed stringers also provide the permanent support for the center support 30. It may be desirable to permanently attach the inner stringers 52 to the center support 30 and the pipe sockets 16 by using an adhesive such as an epoxy.

The outer stringers 50 are similarly inserted into the outer sockets 14. The outer stringers 50 are bowed and inserted into the corresponding holes 38 of the upper ring 32.

Alternatively, the inner and outer stringers, 52 and 50 respectively, can be inserted into the holes 40 and 38 of the lower and upper rings 34 and 32 while the center support 30 is positioned on the slab foundation 12. The center support 30 is then vertically lifted above the slab foundation 12 and the stringers 50, 52 are permitted to deflect downwardly. The lower end of the stringers 50, 52 are then inserted into the sockets 14, 16, completing the erection of the dome framing.

The installation sequence of the inner and outer stringers 52 and 50 is not significant. It may be desirable in certain instances to install the inner shell 62 prior to the installation of the outer stringers 50.

After the inner stringers 52 have been installed, the shell clips 70 are installed on the inner stringers 52 in the manner as shown in FIG. 7. The shell clip 70 has a length extending from the base foundation 12 to the lower ring 34 of the center support 30. The shell clip 70 is flexed into position partially receiving the inner stringer 52 in the manner as shown in FIG. 7. The inner shell clip 70 is held in place by spring tension created by bending the shell clip to conform to the stringer radii, and by abutting the center support 30 and the base foundation 12. The shell clip 70 may be further secured by adhesively bonding the inner shell clip 70 to the inner stringer 52.

The inner shell segments 66 are installed by gluing with epoxy the positioned shell segment 66 to the flanges 72 of the shell clips 70. Pop rivets (not shown) could be installed through the shell segment 66 and the shell clip flange 72 to hold the shell segment in place until the epoxy has set. The joint cover 80 would then be glued to the adjacent shell segments 66. Alternatively, self-adhering FRP tape may be applied over the joint instead of the joint cover 80.

As above described, in the preferred embodiment the shell clip 70 is attached to the inner radius of the inner stringer 52 and the inner shell segments 66 are attached to the outer face of the shell clip flanges 72.

The shell clip 70 is similarly installed and secured to the outer stringer 50 in the same manner as described above and as shown in FIG. 7. The shell clip 70 installed on the outer stringer 50 is attached to the inner radius of the outer stringer 50 such that it will be between the inner and outer shells.

The outer shell segments 64 are installed by gluing with epoxy the positioned shell segment 64 to the flanges 72 of the shell clips 70. Pop rivets (not shown) could be installed through the shell segment 64 and the shell clip flange 72 to hold the shell segment in place until the epoxy has set. The joint cover 80 would then be glued to the adjacent shell segments 64. Alternatively, self-adhering FRP tape may be applied over the joint instead of the joint cover 80.

Doors and windows or portholes are framed in during the installation of the inner and outer shell segments. Additionally, the continuous void space formed between the inner and outer shells provides excellent insulating characteristics while also providing a continuous space to install heating, ventilating and air conditioning ductwork, piping, electrical cables, etc. around the perimeter of the structure 10. Preferably, the ductwork, piping, electrical cables, etc. are installed prior to the outer shell being installed for easy access.

The resulting dome-shaped structure 10 is a structurally secure unit as assembled. The skylight dome 90 is installed above the center support 30 to provide natural lighting in the interior of the structure 10. Insulation may be installed between the inner and outer shells if desired. One method of installation is to blow the insulation into the void space between the inner and outer shells 62 and 60 through the open spaces between the upper and lower rings 32 and 34 of the center support 30. After the insulation has been installed, if any, the seal 31 is installed against the upper and lower rings 32 and 34 of the center support 30 to thus seal off the void space formed between the inner and outer shells.

Epoxy is used to seal the outer shell 60 to the upper ring 32 and to the slab foundation 12, and to seal the door framing 92 and the window or porthole framing to the inner and outer shells. Epoxy may also be used to seal the seal 31 with the center support 30.

The interior walls of the structure 10 are installed by placing the partitions 94A and 94B into the desired configuration with the formed partition 94A abutting the inner shell 62 or shell clip 70. The U-shaped channel 97 of the partition stay 96 is placed over the top of the partition 94B and the clip 101 is positioned against a shell clip 70. The threaded socket 99 is rotated to extend the threaded rods 98 and 100 until the partition 94B is firmly secured by the partition stay 92. The partition stays 96 secure the partitions in the desired location. Preferably, the height of the partitions is such that the partitions will not block the natural lighting obtained through the skylight dome 90.

The foregoing disclosure and description of the invention is illustrative and explanatory thereof, and various changes in the size, shape, and materials, as well as in the details of illustrative construction and assembly, may be made without departing from the spirit of the invention.

I claim:

1. A dome-shaped structure comprising:

a base foundation;

a plurality of initially substantially straight flexible outer stringers, each said outer stringer having a first end and a second end wherein said first ends of said plurality of outer stringers are circumferentially spaced and attached to said base foundation;

a plurality of initially substantially straight flexible inner stringers, each said inner stringer having a first end and a second end wherein said first ends of said plurality of inner stringers are circumferentially spaced and attached to said base foundation; and means for supporting said second end of said plurality of inner and outer stringers substantially centrally and inwardly located above said base foundation, wherein said base foundation and said means for supporting maintain said inner and outer stringers in a flexurally-stressed arcuate configuration and said circumferentially spaced inner stringers are located within the periphery formed by the circumferentially spaced outer stringers at said base foundation.

2. The structure according to claim 1, wherein said plurality of inner and outer stringers are cylindrical members.

3. The structure according to claim 1, wherein said first ends of said plurality of inner and outer stringers are substantially vertical and said second ends of said plurality of inner and outer stringers are substantially horizontal.

4. The structure according to claim 1, wherein said second ends of said plurality of inner stringers are below said second ends of said plurality of outer stringers.

5. The structure according to claim 1, further comprising:

an outer shell attached to the plurality of outer stringers; and an inner shell attached to the plurality of inner stringers, wherein a substantially continuous enclosed space is formed between said inner and outer shells.

6. The structure according to claim 1, wherein said means for supporting comprises a ring assembly having a plurality of circumferentially spaced upper means for attaching said second ends of said plurality of outer stringers to said ring assembly, and a plurality of circumferentially spaced lower means for attaching said second ends of said plurality of inner stringers to said ring assembly.

7. The structure according to claim 6, wherein said upper and lower means for attaching comprise openings sized to receive the periphery of said inner and outer stringers.

8. The structure according to claim 1, further comprising:

a plurality of outer sockets circumferentially spaced in said base foundation; and a plurality of inner sockets circumferentially spaced in said base foundation, wherein each said outer socket receives a said first end of said outer stringer and each said inner socket receives a said first end of said inner stringer.

9. The structure according to claim 1, wherein each said inner stringer is spaced approximately midway between two adjacent outer stringers within the periphery formed by the circumferentially spaced outer stringers at said base foundation.

10. A dome-shaped structure comprising:

a base foundation;

a plurality of initially substantially straight flexible outer stringers, each said outer stringer having a first end and a second end, wherein said first ends of said plurality of outer stringers are circumferentially spaced and attached to said base foundation;

a plurality of initially substantially straight flexible inner stringers, each said inner stringer having a first end and a second end, wherein said first ends of said plurality of inner stringer are circumferentially spaced and attached to said base foundation;

means for supporting said second end of said plurality of inner and outer stringers substantially centrally and inwardly located above said base foundation, wherein said base foundation and said means for supporting maintain said inner and outer stringers in a flexurally-stressed arcuate configuration and said circumferentially spaced inner stringers are located within the periphery formed by the circumferentially spaced outer stringers at said base foundation and said second end of said plurality of inner stringers are below said second ends of said plurality of outer stringers;

an outer shell attached to said plurality of outer stringers; and an inner shell attached to said plurality of inner stringers, wherein a substantially continuous enclosed space is formed between said inner and outer shells.

11. The structure according to claim 10, each said inner stringer is spaced approximately midway between two adjacent outer stringers within the periphery formed by the circumferentially spaced outer stringers at said base foundation.

12. The structure according to claim 11, wherein said means for supporting comprises a ring assembly having a plurality of circumferentially spaced upper means for attaching said second ends of said plurality of outer stringers to said ring assembly, and a plurality of circumferentially spaced lower means for attaching said second ends of said plurality of inner stringers to said ring assembly.

13. The structure according to claim 12, further comprising:

a plurality of outer sockets circumferentially spaced in said base foundation; and a plurality of inner sockets circumferentially spaced in said base foundation, wherein each said outer socket receives a said first end of said outer stringer and each said inner socket receives a said first end of said inner stringer.

14. The structure according to claim 11, wherein said plurality of inner and outer stringers are elongated cylindrical members which assume a flexed configuration when positioned between said base foundation and said means for supporting.

15. A method for constructing a dome-shaped structure, comprising the steps of:

installing a foundation;

attaching a plurality of substantially straight stringers to the foundation;

positioning a support assembly in a substantially central position above the foundation;

flexing the plurality of stringers to a substantially horizontal position at the support assembly;

attaching the plurality of stringers to the support assembly; and maintaining the plurality of stringers in a flexurally-stressed arcuate configuration between the foundation and the support assembly.

16. The method according to claim 15, further comprising the step of:

attaching a plurality of shell sections to the stringers.

17. A method for constructing a dome-shaped structure, comprising the steps of:

pouring a concrete foundation;

inserting a plurality of outer sockets in the foundation to form an outer periphery;

inserting a plurality of inner sockets in the foundation to form an inner periphery;

positioning a support assembly in a substantially central position above the foundation;

attaching a plurality of substantially straight inner and outer stringers in a substantially horizontal position to the support assembly;

flexing the plurality of inner and outer stringers to a substantially vertical position at the foundation;

inserting an end of the plurality of inner stringers in the inner sockets;

inserting an end of the plurality of outer stringers in the outer sockets; and bonding the plurality of inner and outer stringers to the plurality of inner and outer sockets.

18. The method according to claim 17, further comprising the steps of:

attaching a plurality of inner shell sections to the inner stringers; and attaching a plurality of outer shell sections to the outer stringers.

19. The method according to claim 17, further comprising the step of:

installing a skylight over the support assembly.

20. The method according to claim 18, wherein the steps of attaching the inner and outer shell sections to the inner and outer stringers respectively further comprises the steps of:

attaching an inner shell clip to each of the inner stringers;

attaching an outer shell clip to each of the outer stringers;

gluing an inner shell section to the inner shell clips; and gluing an outer shell section to the outer shell clips.

21. A dome-shaped structure comprising:

a base foundation;

a plurality of initially substantially straight flexible stringers, each said flexible stringer having a first end and a second end, wherein said first ends of said plurality of stringers are circumferentially spaced and attached to said base foundation; and means for supporting said second ends of said plurality of flexible stringers substantially centrally and inwardly located above said base foundation, wherein said base foundation and said means for supporting maintain said inner and outer stringers in a flexurally-stressed arcuate configuration.

22. The structure according to claim 21, wherein said first ends of said plurality of flexible stringers are substantially vertical and said second ends of said plurality of flexible stringers are substantially horizontal.

* * * * *

UNITED STATES PATENT AND TRADEMARK OFFICE

CERTIFICATE OF CORRECTION

PATENT NO. : 5,313,763

DATED : May 24, 1994

INVENTOR(S) : John G. Oram

It is certified that error appears in the above-identified patent and that said Letters Patent is hereby corrected as shown below:

At column 1, line 7, after "dome-shaped", change "s" to —structures—.

Signed and Sealed this

Twenty-seventh Day of September, 1994

*Attest:*

*Attesting Officer*

BRUCE LEHMAN

*Commissioner of Patents and Trademarks*